US009205532B2

(12) United States Patent
Lin et al.

(10) Patent No.: US 9,205,532 B2
(45) Date of Patent: Dec. 8, 2015

(54) PRESSURE-ADJUSTING APPARATUS FOR VISE

(71) Applicants: Tseh-Pei Lin, Taichung (TW); Chang-Chih Lin, Taichung (TW)

(72) Inventors: Tseh-Pei Lin, Taichung (TW); Chang-Chih Lin, Taichung (TW)

( * ) Notice: Subject to any disclaimer, the term of this patent is extended or adjusted under 35 U.S.C. 154(b) by 114 days.

(21) Appl. No.: 14/229,952

(22) Filed: Mar. 30, 2014

(65) Prior Publication Data

US 2014/0319752 A1 Oct. 30, 2014

(30) Foreign Application Priority Data

Apr. 26, 2013 (TW) ..... 102114998

(51) Int. Cl.

| | |
|---|---|
| ***B25B 1/02*** | (2006.01) |
| ***B25B 1/24*** | (2006.01) |
| ***B25B 1/10*** | (2006.01) |
| *B25B 5/10* | (2006.01) |

(52) U.S. Cl.
CPC . *B25B 1/24* (2013.01); *B25B 1/103* (2013.01); *B25B 5/107* (2013.01)

(58) Field of Classification Search
USPC ..... 269/165
See application file for complete search history.

(56) References Cited

U.S. PATENT DOCUMENTS 2,369,901 A * 2/1945 Kozaroczy ..... B25B 1/103 269/244
2,370,042 A * 2/1945 Jesionowski ..... B24B 41/06 269/241
2,407,341 A * 9/1946 Meyer ..... B25B 1/103 269/160
2,435,888 A * 2/1948 Jesionowski ..... B25B 1/22 269/240
2,437,200 A * 3/1948 Kuppersmith ..... B25B 1/06 192/223.1
2,780,123 A * 2/1957 Johanson ..... B25B 1/103 269/167
4,448,406 A * 5/1984 Hallberg ..... B25B 1/103 269/224
5,351,943 A * 10/1994 Milz ..... B25B 1/2478 269/153
5,435,466 A * 7/1995 Du ..... B67D 1/103 222/108
8,109,494 B1 * 2/2012 Warth ..... B25B 1/125 269/136
8,454,004 B1 * 6/2013 Warth ..... B25B 1/2468 269/228
8,573,578 B1 * 11/2013 Warth ..... B25B 1/125 269/228
8,690,138 B2 * 4/2014 Lin ..... B25B 1/106 269/240

* cited by examiner

*Primary Examiner* — Lee D Wilson
*Assistant Examiner* — Alvin Grant

(57) ABSTRACT

A pressure-adjusting apparatus for vise including a bolt and a pressure-adjusting element is provided. The bolt having a plurality of positioning holes is adapted for connecting to a vise. The pressure-adjusting element is sleeved onto the bolt movably. The distance between the pressure-adjusting element and the vise can be changed by moving the pressure-adjusting element so as to adjust the clamping force of the vise. A positioning member of the pressure-adjusting element is stocked in one of the positioning holes when the pressure-adjusting element is moving so that the pressure-adjusting element can be fixed at a preset location. Thus, the pressure-adjusting apparatus for vise of the present invention is more convenient for pressure adjustment.

10 Claims, 7 Drawing Sheets

PRESSURE-ADJUSTING APPARATUS FOR VISE

BACKGROUND OF THE INVENTION

1. Field of the Invention

The present invention relates to a pressure-adjusting structure for a vise.

2. Description of the Prior Art

A convention pressure-adjusting structure for vise, as disclosed in patent TW M356571, a core is disposed in front of the driving device of the main body. An elastic element is sleeved onto a rear portion of the core, and a rear end of the elastic element abuts against the main body. A socket and a pushing element are connected with a front end of the core. The socket and the pushing element have corresponding internal threads and external threads. The pushing element is fixedly disposed on the driving device. The compression of the elastic element can be adjusted by rotating the pushing element. As a result, the maximum clamping force can be set up.

However, it is difficult to accurately rotate the pushing element, so the maximum clamping force is difficult to be set up at predetermined amounts. Besides, gap between the pushing element and the socket is formed due to the threading structure, so dust may easily enter the gap. As a result, when the pushing element rotates with respect to the socket, the pushing element and the socket may be abraded.

SUMMARY OF THE INVENTION

The main object of the present invention is to provide a pressure-adjusting apparatus for vise which is easy to make adjustment and is able to prevent abrasion.

To achieve the above and other objects, a pressure-adjusting apparatus of the present invention includes a bolt and a pressure-adjusting element wherein the pressure-adjusting apparatus is adapted for being installed on a vise having a first receiving hole.

The bolt defines an axial direction and a radial direction. The bolt has a first end and an opposite second end along the axial direction. The first end of the bolt is adapted for disposed in the first receiving hole of the vise. The bolt is formed with a plurality of positioning holes on a peripheral face thereof near the second end. The pressure-adjusting element is sleeved onto the second end of the bolt. The pressure-adjusting element is non-rotatable with respect to the bolt. The pressure-adjusting element is movable with respect to the axial direction so as to change a distance between the pressure-adjusting element and the vise. The pressure-adjusting element has at least one positioning structure. The positioning structure includes a positioning element and a first elastic element. The first elastic element pushes the positioning element toward the bolt. The positioning element is able to alternatively insert into one of the positioning holes to abut against the bolt.

Thereby, the distance between the pressure-adjusting element and the vise is able to be changed by moving the pressure-adjusting element so as to adjust the clamping force of the vise. In addition, the positioning element and the positioning hole helps the pressure-adjusting element be positioned at predetermined positions. Besides, the pressure-adjusting element is non-rotatable with respect to the bolt so that the apparatus is prevented from abrasion. Thus, the apparatus of the present invention is more durable.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
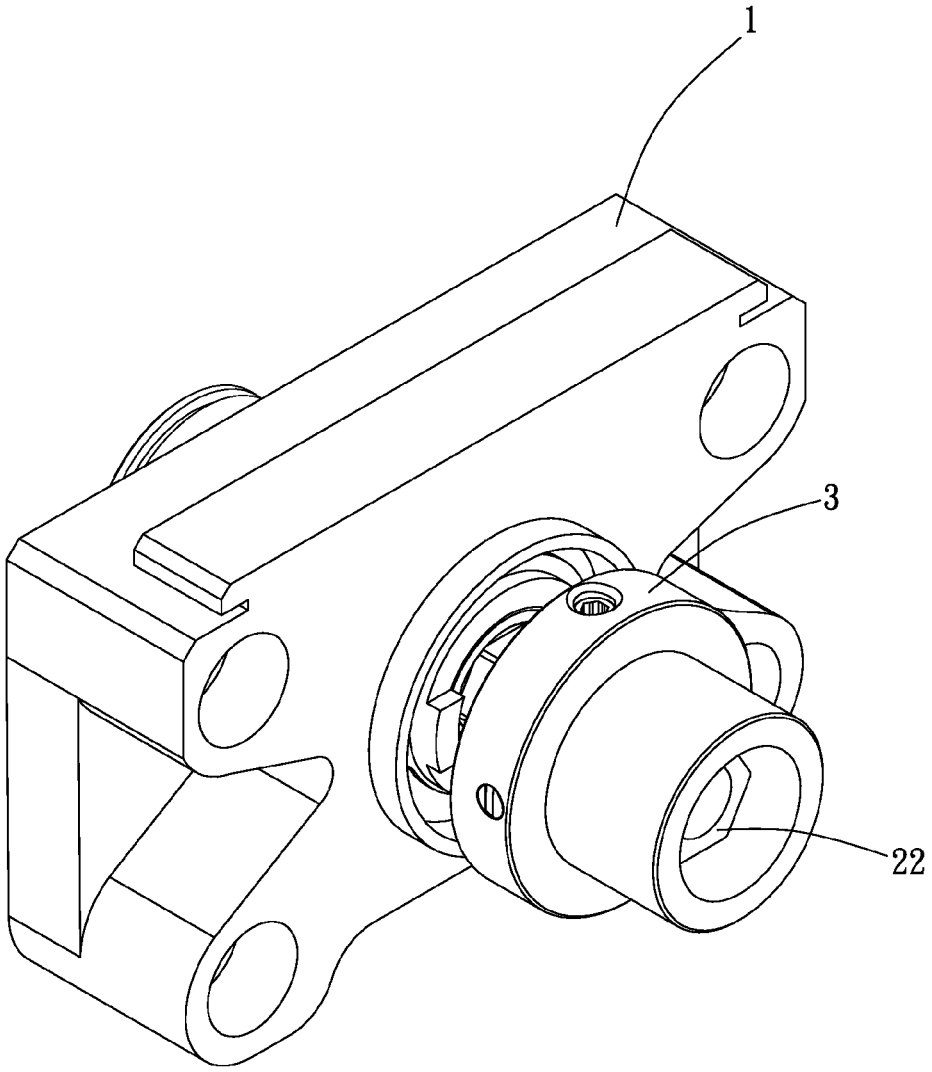
FIG. 1 is a stereogram of the present invention.
Figure 2:
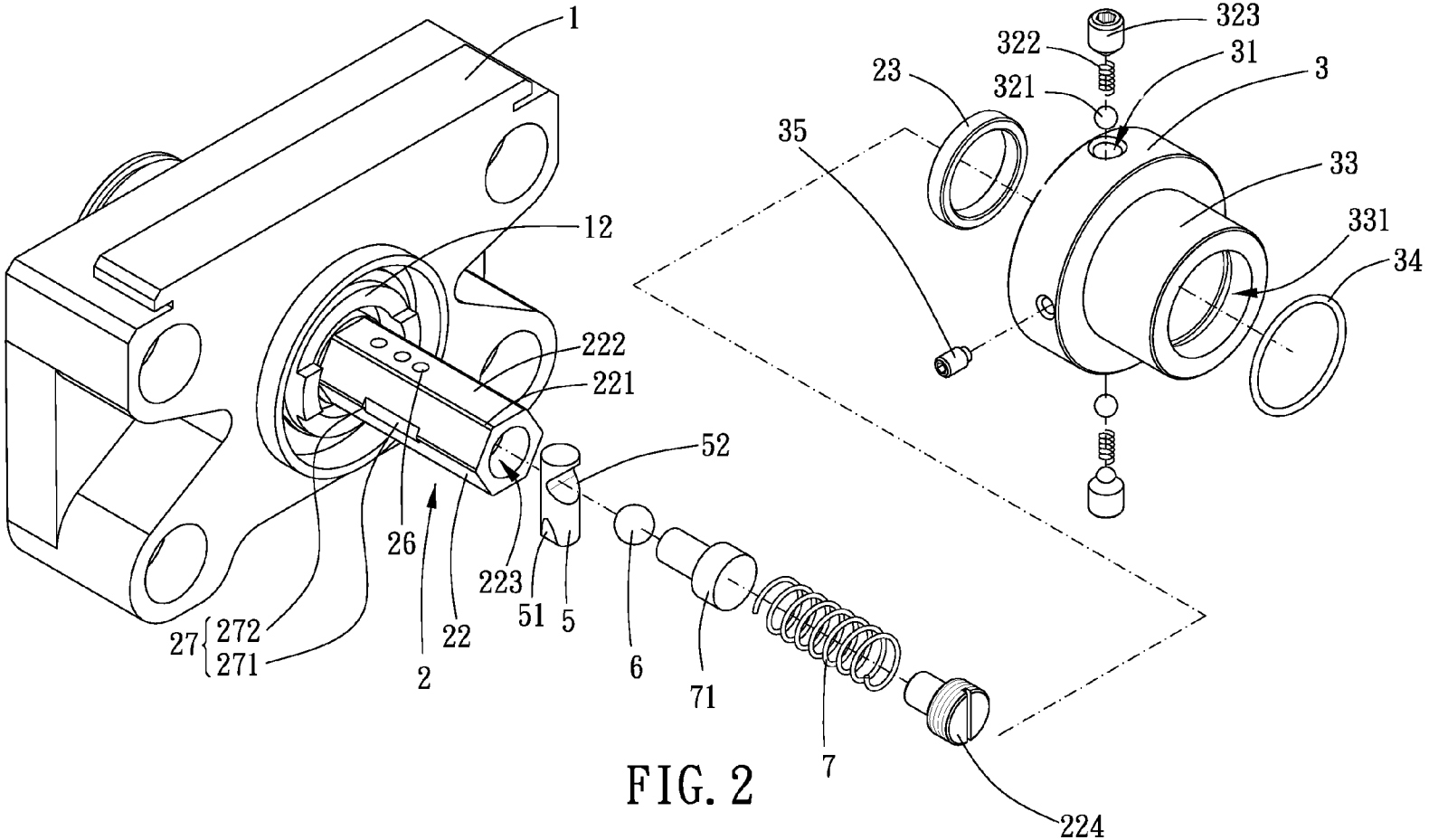
FIG. 2 is a breakdown drawing of the present invention.
Figure 3:
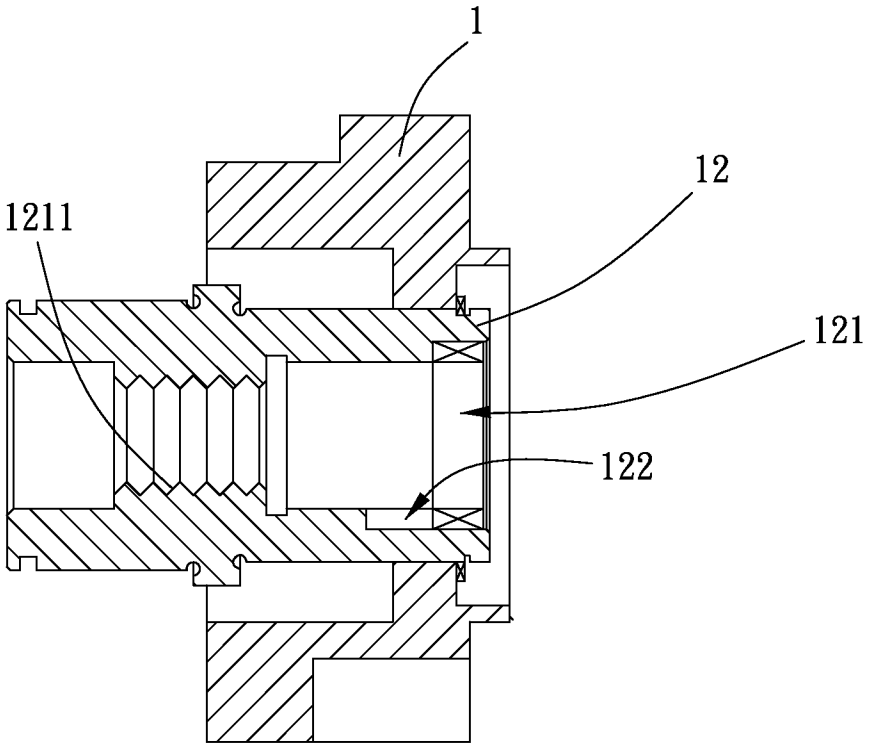
FIG. 3 is a partial profile showing a first embodiment of the present invention.

Please refer to FIG. 1 to FIG. 4, the pressure-adjusting apparatus of the present invention is adapted for being installed on a vise including a connecting seat 1. The pressure-adjusting apparatus of the present invention includes a bolt 2 and a pressure-adjusting element 3.

The connecting seat 1 is located at an end of the vise and has a connecting element 12. The connecting element 12 is adapted for connecting with a threaded rod trigger device of the vise. The connecting element 12 is formed with a first receiving hole 121 having a threaded section 1211. In addition, the connecting element 12 is formed with an elongated groove 122 on an inner surface of the first receiving hole 121.

The bolt 2 defines an axial direction and a radial direction. The bolt 2 has a first end 21 and an opposite second end 22 along the axial direction. The first end 21 of the bolt 2 is received in the first receiving hole 121. In the present embodiment, the first end 21 of the bolt 2 has external threads to screw with the threaded section 1211 of the first receiving hole 121. To enhance sealing between the bolt 2 and the connecting element 12 of the vise, at least one sealing element is arranged between the bolt and the connecting element. In the present embodiment, the sealing element is a dustproof ring 23. The second end 22 of the bolt is polygonal rod-shaped to have a plurality of corners 221 and a plurality of faces 222. The bolt 2 is formed with a first through hole 24 extending along the radial direction between the first end and the second end. The bolt 2 is further formed with a second through hole 25 extending along the axial direction at the second end. The second through hole 25 communicates with the first through hole 24. The bolt 2 is formed with an opening 223 communicating with the second through hole 25 at the second end 22, and a detachable covering element 224 such as a dustproof bolt is arranged on the opening 223. The bolt 2 is formed with a plurality of positioning holes 26 on a peripheral surface thereof neat the second end. More specifically, the positioning holes 26 are formed on one of the faces 22 and are aligned along the axial direction.

The pressure-adjusting element 3 is non-rotatably sleeved onto the second end 22 of the bolt 2. The pressure-adjusting element 3 is movable with respect to the bolt along the axial direction so as to change the distance between the pressure-adjusting element 3 and the connecting seat 1 of the vise. In the present embodiment, the pressure-adjusting element 3 has a polygonal hole corresponding to the bolt 2 to make the pressure-adjusting element 3 non-rotatable with respect to the bolt 2. The pressure-adjusting element 3 has a second receiving hole 31 having internal threads and a positioning structure. The positioning structure includes a positioning element 321, a first elastic element 322, and a fastening element 323. The positioning element 321, the first elastic element 322, and the fastening element 323 are received in the second receiving hole 31, and the first elastic element 322 is located between the fastening element 323 and the positioning element 321. Practically, the positioning element 321 is a ball and is near the bolt 2. The first elastic element 322 pushes the positioning element 321 toward the bolt 2. The fastening element 323 includes threads to screw with the second receiving hole 31. The fastening element 323 is movable with respect to the second receiving hole 31 to move toward or away from the first elastic element 322. Thus, the elastic force to the positioning element 321 provided by the first elastic element 322 can be adjusted by changing the position of the fastening element 323.

Thereby, the present invention can be installed on a vise, and a tool such as a ratchet wrench is connected to the second end 22 of the bolt 2 so as to drive the bolt. In the present embodiment, the pressure-adjusting element 3 has a sleeve portion 33 which has smaller external diameters at an end thereof. The sleeve portion 33 has a sleeve hole 331 adapted for a tool 4 to insert in so as to connect to the second end 22 of the bolt 2. Thus, the portion of the tool 4 inserted through the sleeve hole 331 is located between the sleeve portion 33 and the second end 22 of the bolt 2. The tool 4 is covered by the sleeve portion 33 for dustproof. Besides, in the present embodiment, a sealing element 34 such as an o-ring is arranged between the pressure-adjusting element 3 and the tool 4 for sealing.

Figure 4:
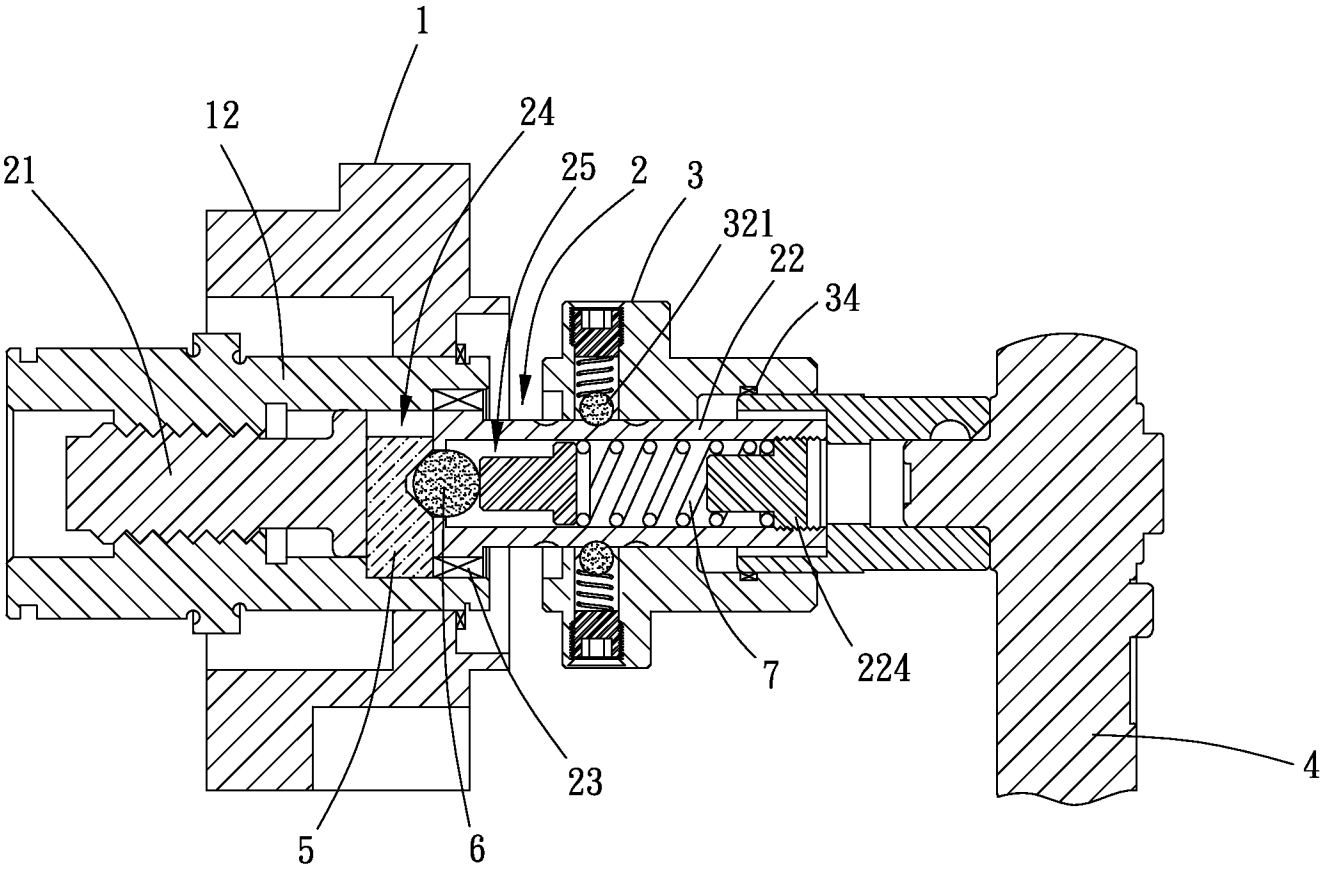
FIGS. 4 to 7 are profiles of the present invention during operation.
Figure 5:
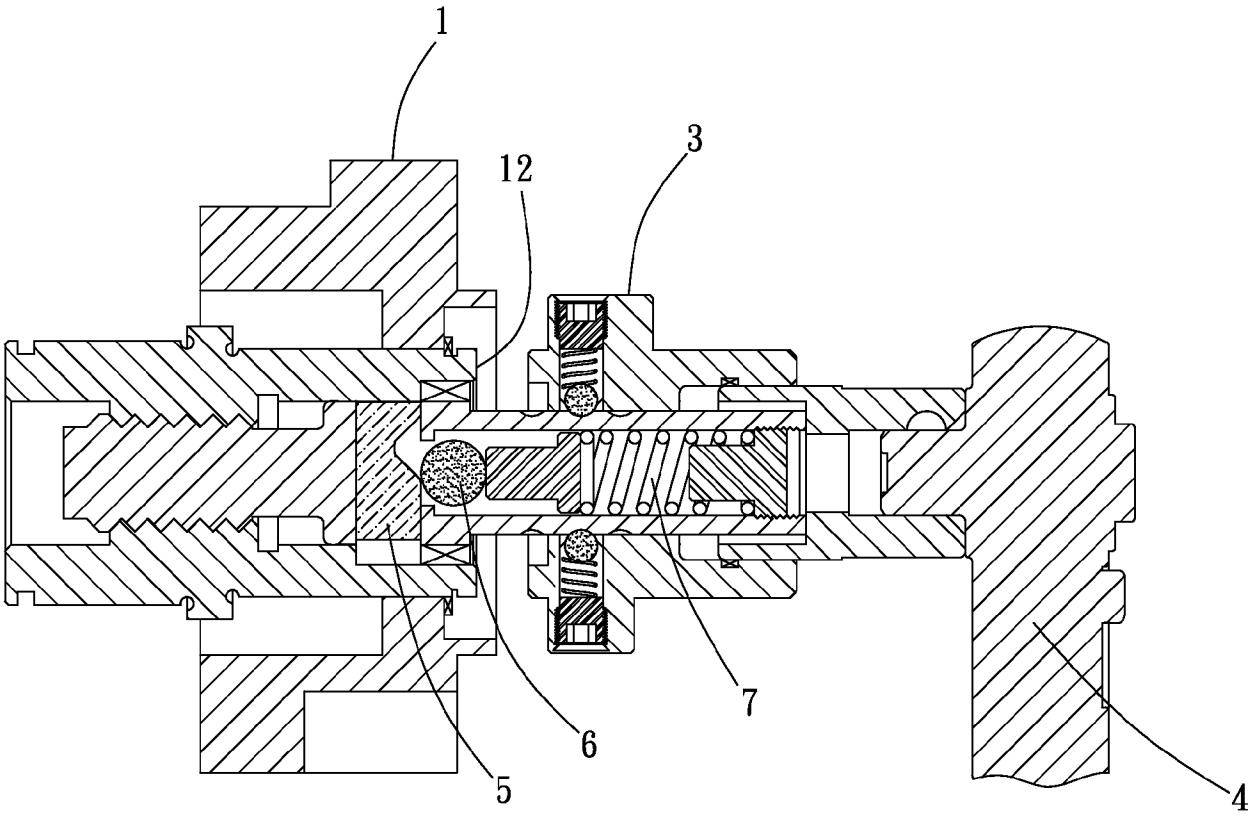

In the present embodiment, the apparatus of the present invention further includes a pin 5, a ball 6, and a second elastic element 7. The pin 5 is movably disposed in the first receiving through hole 24 protrudingly. The pin 5 is formed with an abutting face 51 at an end near the elongated groove wherein the abutting face is inclined with respect to a longitudinal direction of the pin 5. In addition, the pin 5 is formed with a notch whose cross-section is substantially V-shaped. The second elastic element 7 is received in the second through hole 25. The ball 6 is located between the pin 5 and the second elastic element 7. An end of the second elastic element 7 abuts against the covering element 224, and an opposite end of the second elastic element 7 pushes the ball 6 via a pressing rod 71 so that the second elastic element 7 pushes the ball 6 to abut against the notch 52 and that the pin 5 is inserted into the elongated groove 122, as shown in FIG. 4. In use, when the vise clamps a workpiece to generate a resistance larger than the elastic force of the second elastic element 7, the connecting element 12 presses the abutting face of the pin 5 to make the ball 6 push the second elastic element 7 so that the pin 5 is back into the second through hole, as shown in FIG. 4 and FIG. 5. As a result, the bolt 2 is rotatable with respect to the connecting element 12 for driving the vise.

Figure 6:
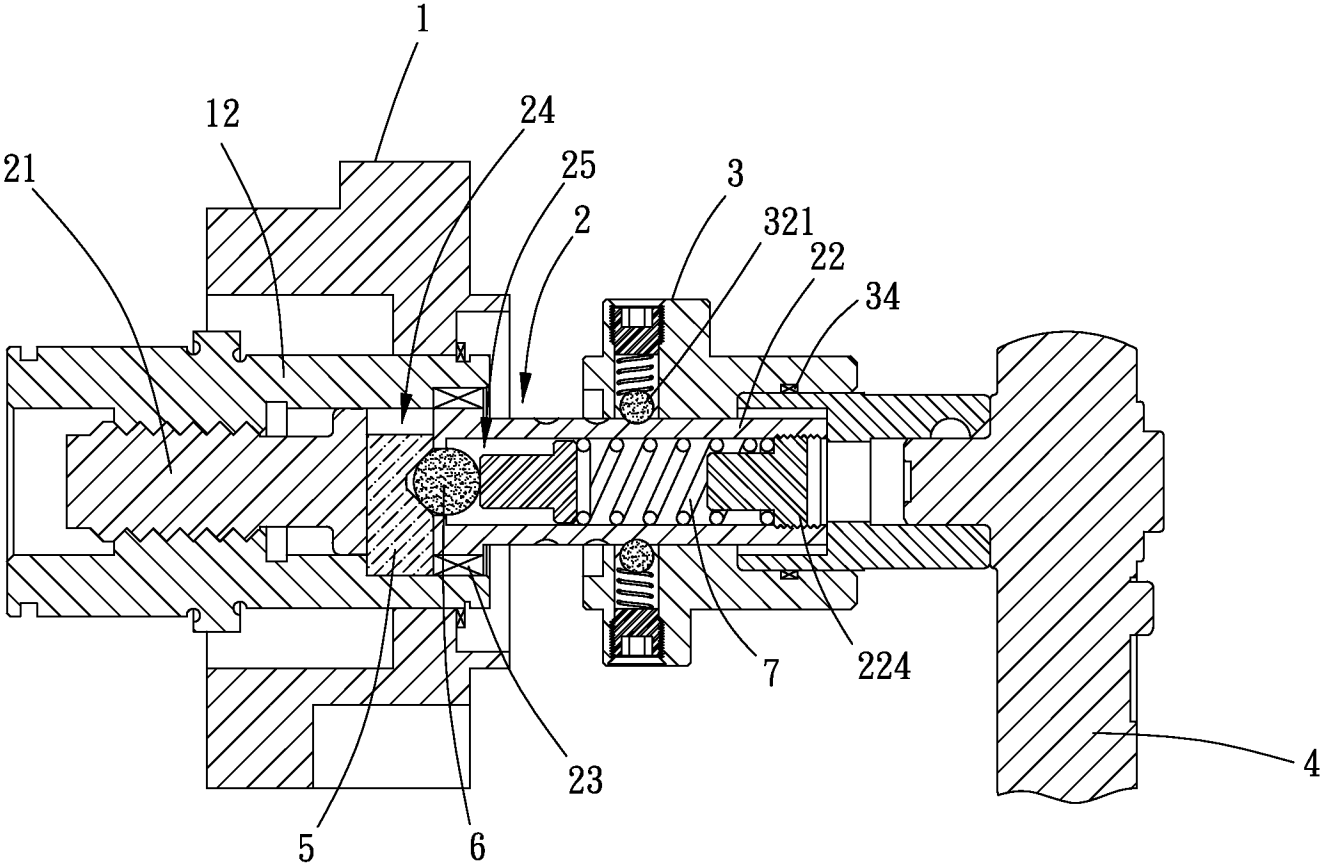
Figure 7:
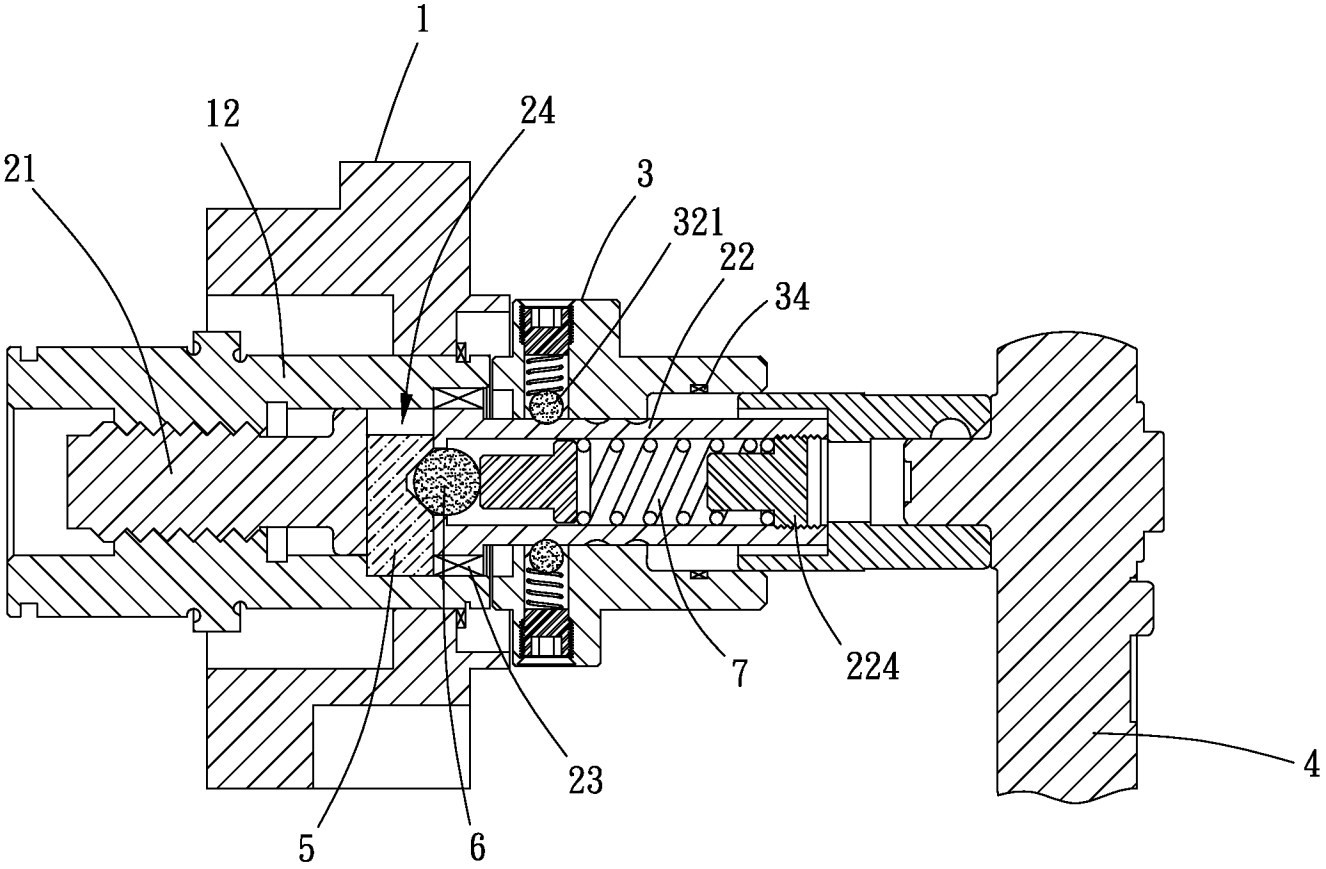

During the operation, the pressure-adjusting element 3 is able to move with respect to the bolt 2 to allow the positioning element 321 to insert into one of the positioning holes to abut against the bolt 2. Thus, the distance between the pressure-adjusting element 3 and the connecting seat 1 can be changed to adjust the clamping force. More specifically, one can drive the pressure-adjusting element 3 to move with respect to the bolt 2 to adjust the positions of the pressure-adjusting element 3 and the connecting seat 1, as shown in FIG. 4, FIG. 6, and FIG. 7. As a result, the maximum clamping force of the vise can be adjusted. Due to the positioning element 321 and the positioning holes 26, the pressure-adjusting element 3 can be positioned at predetermined positions. Thus, by checking the sounds of the positioning element entering the positioning hole, one can move the pressure-adjusting element to desired positions to set up the clamping force. Besides, the pressure-adjusting element is non-rotatable with respect to the bolt, so abrasion is avoided. Thus, the present invention is more durable.

On the other hand, the bolt 2 is formed with a sliding groove 27 on the outer surface thereof wherein the sliding groove 27 extends along the axial direction. More specifically, the sliding groove 27 has a flat face 271 at its bottom and lateral faces 272 beside the flat face 271. A fixing element 35 is screwed with the pressure-adjusting element 3 and is able to enter the sliding groove 27 between the two lateral faces 272. Thereby, the range of the pressure-adjusting element 3 moving with respect to the bolt 2 can be restricted. Practically, the position of the sliding groove corresponds to the positions of the positioning holes. As a result, the pressure-adjusting element 3 is prevented from falling from the bolt 2.

What is claimed is:

1. A pressure-adjusting apparatus for vise, adapted for being installed on a vise having a first receiving hole, the pressure-adjusting apparatus for vise including:

a bolt, defining an axial direction and a radial direction, the bolt having a first end and an opposite second end along the axial direction, the first end of the bolt being adapted for disposal in the first receiving hole of the vise, the bolt being formed with a plurality of positioning holes on a peripheral face thereof near the second end;

a pressure-adjusting element, sleeved onto the second end of the bolt, the pressure-adjusting element being non-rotatable with respect to the bolt, the pressure-adjusting element being movable with respect to the axial direction so as to change a distance between the pressure-adjusting element and the vise, the pressure-adjusting element having at least one positioning structure, the positioning structure including a positioning element and a first elastic element, the first elastic element pushing the positioning element toward the bolt, the positioning element being able to alternatively insert into one of the positioning holes to abut against the bolt.

2. The pressure-adjusting apparatus for vise of claim 1, wherein the second end of the bolt is polygonal rod-shaped to have a plurality of corners and a plurality of faces, the positioning holes are formed on one of the faces.

3. The pressure-adjusting apparatus for vise of claim 1, wherein the bolt is formed with a sliding groove on an outer face thereof, the pressure-adjusting element has a fixing element, the fixing element is inserted into the sliding groove to define a moving range of the pressure-adjusting element.

4. The pressure-adjusting apparatus for vise of claim 1, wherein the pressure-adjusting element has a second receiving hole, the positioning structure further includes a fastening element, the fastening element, the first elastic element, and the positioning element are received in the second receiving hole, the first elastic element is located between the fastening element and the positioning element, the fastening element is movable with respect to the second receiving hole to approach or to depart from the first elastic element.

5. The pressure-adjusting apparatus for vise of claim 1, further including a pin, a ball, and a second elastic element, the vise being formed with an elongated groove on an inner surface of the first receiving hole, the bolt being formed with a first through hole between the first end and the second end wherein the first through hole extends along the radial direction, the bolt being formed with a second through hole at the second end wherein the second through hole extends along the axial direction, the second through hole communicating with the first through hole, the ball being located between the pin and the second elastic element, the second elastic element pushing the ball to make the pin insert into the elongated groove.

6. The pressure-adjusting apparatus for vise of claim 5, wherein the bolt is formed with an opening at the second end to communicate with the second through hole, a detachable covering element is disposed on the opening.

7. The pressure-adjusting apparatus for vise of claim 5, wherein the pin is formed with an abutting face at an end thereof near the elongated groove, the abutting face is inclined with respect to a longitudinal direction of the pin.

8. The pressure-adjusting apparatus for vise of claim 5, wherein the pin is formed with a notch whose cross-section is substantially V-shaped, the second elastic element pushes the ball to abut against the notch so as to make the pin insert into the elongated groove.

9. The pressure-adjusting apparatus for vise of claim 5, wherein the pressure-adjusting element has a sleeve hole adapted for a tool to insert into to link with the second end of the bolt, at least one sealing element is arranged between the pressure-adjusting element and the tool.

10. The pressure-adjusting apparatus for vise of claim 1, wherein at least one sealing element is arranged between the bolt and the vise.

* * * * *